US011795845B2

(12) United States Patent
Schlegelmilch

(10) Patent No.: US 11,795,845 B2
(45) Date of Patent: Oct. 24, 2023

(54) INTERNAL COMBUSTION ENGINE

(71) Applicant: AUDI AG, Ingolstadt (DE)

(72) Inventor: Peter Schlegelmilch, Lenting (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 17/925,174

(22) PCT Filed: Mar. 16, 2021

(86) PCT No.: PCT/EP2021/056663
§ 371 (c)(1),
(2) Date: Nov. 14, 2022

(87) PCT Pub. No.: WO2021/228454
PCT Pub. Date: Nov. 18, 2021

(65) Prior Publication Data

US 2023/0175422 A1 Jun. 8, 2023

(30) Foreign Application Priority Data

May 11, 2020 (DE) ..... 10 2020 112 653.0

(51) Int. Cl.
*F01M 13/00* (2006.01)
*F01M 11/00* (2006.01)

(52) U.S. Cl.
CPC ..... *F01M 13/00* (2013.01); *F01M 11/0004* (2013.01); *F01M 2013/0038* (2013.01)

(58) Field of Classification Search
CPC ..... F01M 13/00; F01M 11/0004; F01M 2013/0038
See application file for complete search history.

(56) References Cited

U.S. PATENT DOCUMENTS 5,038,890 A * 8/1991 Tanaka ..... F01M 11/0004 123/196 R
2007/0283918 A1* 12/2007 Deegan ..... F02F 7/0053 123/196 R (Continued)

FOREIGN PATENT DOCUMENTS

DE 3911014 A1 10/1989
DE 102016107998 B3 10/2017
EP 2039895 A1 3/2009

OTHER PUBLICATIONS

Notification of Transmittal of Translation of the International Preliminary Report on Patentability and Written Opinion, dated Nov. 24, 2022, in corresponding International Application No. PCT/EP2021/056663, 6 pages.

(Continued)

*Primary Examiner* — Syed O Hasan
(74) *Attorney, Agent, or Firm* — Maier & Maier PLLC

(57) ABSTRACT

An internal combustion engine, having a cylinder crankcase delimiting a crank chamber and a lubricant pan accommodating a lubricant sump, which has a lubricant pan upper part arranged between the crank chamber and the lubricant sump and a lubricant pan lower part fastened on the lubricant pan upper part. Multiple ridges originate from a base component of the lubricant pan upper part in the direction of the lubricant sump, which ridges partially intersect and thus form chambers which are peripherally closed in section between them, and lubricant passage openings formed in the lubricant pan upper part open into at least part of the chambers, via which openings the crank chamber and the lubricant sump are fluidically connected.

20 Claims, 1 Drawing Sheet

(56) References Cited

U.S. PATENT DOCUMENTS

| | | | | |
|---|---|---|---|---|
| 2010/0162988 | A1* | 7/2010 | Enokida | F01M 11/0004 123/195 C |
| 2019/0153917 | A1* | 5/2019 | Ono | F01M 11/0004 |

OTHER PUBLICATIONS

International Search Report and Written Opinion dated Jun. 1, 2021, in corresponding International Application No. PCT/EP2021/056663; 13 pages.

* cited by examiner

INTERNAL COMBUSTION ENGINE

FIELD

The invention relates to an internal combustion engine having a cylinder crankcase delimiting a crank chamber and accommodating a lubricant sump, which has a lubricant pan upper part arranged between the crank chamber and the lubricant sump and a lubricant pan lower part fastened on the lubricant pan upper part, wherein multiple ridges originate from a base component of the lubricant pan upper part in the direction of the lubricant sump, which partially intersect and thus form chambers which are preferably closed in section between them, and wherein lubricant passage openings formed in the lubricant pan upper part open into at least part of the chambers, via which the crank chamber and the lubricant sump are fluidically connected.

BACKGROUND

Document EP 2 039 895 B1 is known from the prior art, for example. This describes a structural oil pan for an internal combustion engine, provided with an upper opening and having an element made of plastic, which has multiple side walls that circumferentially delimit an interior, and at least one transverse part which extends in said interior such that it connects at least two of the side walls. It is provided here that the element made of plastic is an upper element, which is formed integrally with the transverse part, wherein the upper element extends between an upper end, which defines said upper opening, and a lower end, which defines a lower opening, and that the pan has a lower element which has a bottom and is fastened on the lower end of the upper element to form a seal, wherein said upper element has inner ribs, which are arranged opposite to one another with respect to the bottom.

SUMMARY

It is the object of the invention to propose an internal combustion engine which has advantages over known internal combustion engines, in particular achieves losses of the internal combustion engine due to a lower lubricant level in the crank chamber.

This is achieved according to the invention by an internal combustion engine. It is provided here that at least one ventilation opening, which additionally fluidically connects the crank chamber and the lubricant sump and has a smaller through-flow cross section in comparison to the lubricant passage openings, opens into at least one of the chambers into which none of the lubricant passage openings opens.

The internal combustion engine is, for example, part of a motor vehicle, but can also be provided separately therefrom. The internal combustion engine is preferably used to drive the motor vehicle, insofar thus to provide a drive torque directed to driving the motor vehicle. The internal combustion engine has the cylinder crankcase, in which the crank chamber is formed.

A crankshaft of the internal combustion engine is rotatably mounted around an axis of rotation in the crank chamber. For its mounting, the crankshaft has bearing pins, using which it is rotatably mounted in bearings which are held or formed by the cylinder crankcase. The bearing pins are arranged coaxially to the axis of rotation of the crankshaft. Furthermore, the crankshaft has crank pins, which are arranged eccentrically with respect to the bearing pins or the crankcase.

The crank pins are connected via webs to the bearing pins. Pistons of the internal combustion engine are attached to the crankshaft via the crank pins. For this purpose, for example, a connecting rod is, on the one hand, rotatably mounted on the crank pin and, on the other hand, rotatably mounted on the piston. The pistons are in turn mounted so they are linearly displaceable in cylinders, wherein the cylinders are formed in the cylinder crankcase.

The crank chamber, in which the crankshaft is arranged, is delimited in the direction facing away from the cylinders by the lubricant pan. This at least has the lubricant pan upper part and the lubricant pan lower part. The lubricant pan accommodates the lubricant sump, which is arranged between the lubricant pan upper part and the lubricant fan lower part. The lubricant pan upper part is arranged between the lubricant pan lower part and the cylinder crankcase. The lubricant pan upper part insofar delimits the lubricant sump in the direction of the crank chamber and the crank chamber in the direction of the lubricant sump.

For example, the lubricant pan upper part is directly fastened on the cylinder crankcase and the lubricant pan lower part is directly fastened on the lubricant pan upper part, respectively. Accordingly, the lubricant pan lower part is only fastened indirectly via the lubricant pan upper part on the cylinder crankcase. Of course, it can also be provided that both the lubricant pan lower part and also the lubricant pan upper part are each directly fastened on the cylinder crankcase. It is solely important that the lubricant pan upper part, the lubricant pan lower part, and the cylinder crankcase are fixed with respect to one another.

During operation of the internal combustion engine, lubricant is supplied to the crank chamber, in particular for lubricating and/or cooling, for example, of the crankshaft, the pistons, the connecting rods, and/or of bearings for mounting the crankshaft and/or the connecting rods. Air is introduced into the lubricant due to the moving parts in the crank chamber. The lubricant introduced into the crank chamber is displaced by the influence of gravity in the direction of the lubricant sump, in particular into the lubricant sump, when the internal combustion engine is arranged as intended.

The lubricant insofar initially arrives on the lubricant pan upper part, namely on the side of the lubricant pan upper part facing toward the crank chamber. The lubricant passage openings, via which the crank chamber and the lubricant sump are fluidically connected to one another, are formed in the lubricant pan upper part.

The lubricant flows through the lubricant passage openings from the crank chamber into the lubricant sump. The lubricant is calmed in the lubricant sump. Air present in the lubricant sump is separated from the lubricant in this case. The lubricant, which is now freed of the air, can subsequently be taken from the lubricant sump again and supplied to the crank chamber. For this purpose, for example, the lubricant is discharged from the lubricant sump by means of a lubricant pump and again conveyed in the direction of the crank chamber or into the crank chamber. Additionally or alternatively, the lubricant is applied to a cylinder head and/or a camshaft adjuster. The lubricant taken from the lubricant sump is preferably supplied to a lubricant filter before it is supplied to the crank chamber, the cylinder head, and/or the camshaft adjuster. The lubricant filter is used to separate dirt particles located in the lubricant.

To achieve the lightest or most weight-saving possible design of the internal combustion engine, at least the lubricant pan upper part is designed like a framework. Accordingly, it has multiple ridges which originate from its base component. The base component delimits the crank chamber in this case in the direction of the lubricant sump and the ridges extend starting from the base component in the direction of the lubricant sump, thus in the direction facing away from the crank chamber.

The ridges partially intersect, in particular at least several of the ridges are intersected by respective other ones of the ridges, so that a chamber structure forms having multiple chambers, which are open in the direction of the lubricant sump. Viewed in section, the ridges thus enclose multiple chambers between them, which are delimited in the direction of the crank chamber by the base component of the lubricant pan upper part. In the intended installation position of the internal combustion engine, the base component insofar forms a ceiling of the chambers.

For example, first ones of the ridges extend in a first direction and second ones of the ridges extend in a second direction different from the first direction. The first ridges extend, for example, in parallel to one another at least in regions or continuously. The first direction is, for example, provided in parallel to the axis of rotation of the crankshaft. In contrast, the second ridges extend at an angle with respect to the first ridges, thus each enclose an angle with these first ridges, which is greater than 0° and less than 180°.

It can be provided in this case that some of the second ridges extend in parallel to one another. However, the second ridges can also be angled in relation to one another or can also extend skewed in relation to one another. It is thus not necessary for the second ridges to each enclose the same angle with the first ridges. Rather, the angles can be different from one another.

The ridges each have a free end on their side facing away from the base component, which protrudes in the direction of the lubricant sump. At least one of the ridges, several of the ridges, or all of the ridges preferably extend at least almost to a contact surface of the lubricant pan upper part, on which the lubricant pan lower part is supported, for example, via a seal. The lubricant pan lower part preferably has a counter contact surface for this purpose, which presses directly or indirectly, for example, via the mentioned seal, against the contact surface of the lubricant pan upper part.

The contact surface is preferably located continuously in an imaginary plane, which is in particular parallel to the axis of rotation of the crankshaft. With respect to an overall height of the lubricant pan upper part, which corresponds, for example, to the distance of the side of the base component facing toward the crank chamber to the imaginary surface, the distance between the ridge, the several ridges, or all ridges in the imaginary plane is preferably at most 25%, at most 20%, at most 15%, at most 10%, or at most 5%.

The ridge particularly preferably merges via a rounding into the contact surface, so that a particularly small distance between the particularly and the contact surface is achieved. A particularly high level of rigidity of the lubricant pan upper part and accordingly of the entire internal combustion engine is provided in this way. This has advantages with respect to the acoustic behavior of the internal combustion engine, because a vibration excitation is reduced due to the high level of rigidity.

The described design of the lubricant pan upper part having the chambers formed by the ridges has the disadvantage, however, that the air separated from the lubricant partially collects in the chambers and remains there. The capacity of the lubricant sump for the lubricant accordingly decreases. A comparatively high lubricant level in the crank chamber follows therefrom. This can have the result that the crankshaft is periodically immersed in the lubricant located in the crank chamber during the operation of the internal combustion engine, so that losses of the internal combustion engine occur. More air is also introduced into the lubricant by the immersion, so that the problem is made even more severe.

For this reason, it is provided that the at least one ventilation opening is formed in the lubricant pan upper part. The ventilation opening opens on one side into the crank chamber and on the other side into one of the chambers. Such a ventilation opening is particularly preferably provided and formed in each of the chambers into which none of the lubricant passage openings opens. To nonetheless obtain the high level of rigidity of the lubricant pan upper part, the ventilation openings are made small in comparison to the lubricant passage openings. This is to be understood to mean that they have a smaller through-flow cross section, their through-flow cross section thus has a smaller through-flow cross-sectional area than the lubricant passage openings.

In this way, it is ensured on the one hand that the corresponding chamber can be reliably vented, thus that the volume of the chamber is available to accommodate lubricant. However, it is ensured at the same time that the structure of the internal combustion engine is not weakened, so that undesired acoustic anomalies of the internal combustion engine are reliably avoided.

One refinement of the invention provides that the lubricant passage openings are formed in walls of the lubricant pan upper part, which delimit depressions that are open in the direction of the crank chamber and are spaced apart from one another, wherein the depressions are arranged overlapping with crank pins of the crankshaft in the axial direction with respect to an axis of rotation of a crankshaft.

The walls are to be understood as regions of the lubricant pan upper part which are preferably provided thereon spaced apart from one another. The walls delimit the depressions in which lubricant collects during the operation of the internal combustion engine and passes through the lubricant passage openings into the lubricant sump. The depressions can insofar also be referred to as lubricant collection depressions.

The depressions are provided overlapping with the crank pins of the crankshaft viewed in the axial direction with respect to the axis of rotation of the crankshaft. This is to be understood to mean that one of the depressions is respectively arranged overlapping with each of the crank pins. Vice versa, one of the crank pins of the crankshaft is preferably arranged overlapping with each of the depressions. In this way, lubricant flung off of the crankshaft reaches the depressions directly and can be discharged therefrom into the lubricant sump. The lubricant pan upper part and in particular the walls accordingly represent a "lubricant slicer" of the internal combustion engine. For example, it can be provided that the crank pins of the crankshaft, the webs of the crankshaft, and/or the connecting rods at least temporarily engage in the depressions during the operation of the internal combustion engine. In this way, particularly effective discharge of the lubricant from the crank chamber in the direction of the lubricant sump is achieved. The depressions are made toroidal, for example, thus preferably have the form of a section of a torus. The torus is preferably understood as a rotation torus, which is in turn provided as a rotation body of a circle.

One refinement of the invention provides that the lubricant passage openings are provided in two rows arranged in parallel to one another and to the axis of rotation of the crankshaft, wherein fastening recesses or formed between the two rows in the lubricant pan upper part, which are enclosed by the ridges. The parallel arrangement of the rows in relation to one another and to the axis of rotation of the crankshaft is to be understood as an at least approximately parallel arrangement or a precisely parallel arrangement. In the first case, for example, there is an angle of at most 10°, at most 5°, or at most 2.5° between the rows and/or one of the rows and the axis of rotation.

At least two of the lubricant passage openings are provided in each of the rows. The fastening recesses are formed between the rows, which extend completely through the base component of the lubricant pan upper part. Each of the fastening recesses is preferably enclosed by the ridges, for example, for this purpose one or more ridges merge into a ring ridge which completely surrounds the respective fastening recess. Several of the ridges particularly preferably originate from each of the ring ridges. For example, the ring ridges are enclosed by two ridges extending in parallel to one another, which abut the ring ridges or merge into the ring ridges.

The fastening recesses are used to accommodate fastening elements, for example, screws or bolts, by means of which the lubricant pan upper part is fastened, for example, to the cylinder crankcase and/or the lubricant pan lower part. The central arrangement of the fastening recesses with respect to the lubricant passage openings enables a particularly rigid and low-vibration design of the lubricant pan upper part.

One refinement of the invention provides that in addition to the ventilation opening, at least one further ventilation opening is provided, wherein a through-flow cross section of the further ventilation opening is larger than a through-flow cross section of the ventilation opening and smaller than the through-flow cross section of the lubricant passage openings. The at least one further ventilation opening is provided in addition to the at least one ventilation opening. Like the ventilation opening, it extends through the base component of the lubricant pan upper part and fluidically connects the lubricant sump to the crank chamber. Moreover, it can be provided that it opens into one of the chambers.

The further ventilation opening has a larger through-flow cross section than the ventilation opening. For example, the through-flow cross-sectional area of the through-flow cross section of the further ventilation opening is larger by a factor of at least 5, at least 7.5, or at least 10 than the through-flow cross-sectional area of the through-flow cross section of the ventilation opening. Particularly effective ventilation of the lubricant sump is achieved by means of the further ventilation opening.

Of course, multiple further ventilation openings are preferably provided. However, so as not to excessively negatively affect the rigidity of the lubricant pan upper part, the number of the further ventilation openings is less than the number of the ventilation openings. For example, the lubricant pan upper part has more ventilation openings than further ventilation openings by a factor of at least 2, at least 3, at least 4, or at least 5. Effective ventilation is achieved in this way, with a high level of rigidity of the internal combustion engine at the same time.

One refinement of the invention provides that the lubricant passage openings are non-round and the ventilation opening is round. To discharge the lubricant as efficiently as possible from the crank chamber into the lubricant sump, the lubricant passage openings have a non-round shape. For example, the lubricant passage openings are designed in the form of an oblong hole or stadium. Of course, they can also be oval, for example, ellipsoidal.

In each case, they have a greater extension in a first direction than in a second direction perpendicular to the first direction, wherein they are delimited in each of the directions by a continuous edge, which is formed by the base component of the lubricant pan upper part. For example, the lubricant passage openings extend through the respective depression in the axial direction with respect to the axis of rotation of the crankshaft by at least 70%, at least 80%, or at least 90%.

In contrast, the ventilation opening is round, to implement the least possible impairment of the rigidity of the lubricant pan upper part. This means that an edge, which delimits the ventilation opening and is again formed by the base component, is provided as a circle or as a ring. The described design thus enables both effective discharge of the lubricant from the crank chamber and also effective ventilation of the lubricant sump.

One refinement of the invention provides that the ventilation opening is formed in a region, which is geodetically highest in the installed location of the internal combustion engine, of a region of the base component delimiting the respective chamber. The region of the base component thus forms the roof of the respective chamber in the intended installation position. This roof is penetrated by the ventilation opening, namely at the point of the roof located geodetically highest. Particularly effective ventilation of the chamber is achieved in this way.

One refinement of the invention provides that the ventilation opening is formed in one of the walls. The walls are to be understood as those regions of the lubricant pan upper part which delimit the depressions which are open in the direction of the crank chamber and were described above. This applies in particular if none of the lubricant passage openings opens into the chamber which is delimited by the wall in the direction of the crank chamber. Such a chamber is located, for example, between the fastening recesses. The production of the ventilation opening in the wall delimiting the chamber ensures sufficient ventilation at this point.

One refinement of the invention provides that the further ventilation opening has dimensions in a first direction which are at least 75% and/or at most 125% of dimensions of one of the lubricant passage openings in the same direction and/or that the further ventilation opening has dimensions in a second direction perpendicular to the first direction which are at most 25% of dimensions of the lubricant passage openings in this direction.

In each case, both the further ventilation opening and also the lubricant passage opening are delimited both in the first direction and in the second direction by a continuous respective edge. The two directions are perpendicular to one another and each intersect the corresponding edge of the respective opening.

It is now provided, for example, that the further ventilation opening has similar dimensions in the first direction than the lubricant passage opening, but is significantly smaller than this opening in the second direction. Accordingly, the dimensions of the further ventilation opening in the first direction are at least 75%, at least 80%, at least 85%, or at least 90% of the dimensions of the lubricant passage opening.

Additionally or alternatively, the dimensions of the further ventilation opening are at most 125%, at most 120%, at most 115%, or at most 110% of the dimensions of the lubricant passage opening. The dimensions of the first ventilation opening in the first direction particularly preferably correspond to the dimensions of the lubricant passage opening, also in the first direction.

Additionally or alternatively, the dimensions of the further ventilation opening in the first direction are at most 50%, at most 25%, at most 20%, at most 15%, or at most 10% of the dimensions of the lubricant passage opening, also in the second direction. Such a design of the further ventilation opening enables particularly effective ventilation opening without impermissibly reducing the rigidity of the lubricant pan upper part. The further ventilation opening is particularly preferably round.

One refinement of the invention provides that the ventilation opening has dimensions in the first direction and the second direction which are at most 25% of the dimensions of the further ventilation opening in the respective direction. In other words, the ventilation opening is significantly smaller than the further ventilation opening. Preferably, both the ventilation opening and the further ventilation opening are round.

This means that a diameter of the ventilation opening is at most 25% of a diameter of the further ventilation opening. The dimensions or the diameter are particularly preferably less than 25%, however, preferably they are at most 20%, at most 15%, or at most 10%. In this way, a high level of rigidity of the lubricant pan upper part is effectuated with good ventilation at the same time.

One refinement of the invention provides that the ventilation opening has a diameter of at least 1 mm and/or of at most 6 mm. The lower limit of 1 mm is used to achieve sufficient ventilation of the respective chamber through the ventilation opening. The upper limit of 6 mm is used to avoid disadvantageous influences on the rigidity of the lubricant pan upper part. For example, the diameter is thus at least 1 mm and at most 6 mm, at most 5 mm, at most 4 mm, at most 3 mm, or at most 2 mm. Alternatively, the diameter can be at least 2 mm and at most 6 mm, at most 5 mm, at most 4 mm, or at most 3 mm. Furthermore, the diameter is alternatively at least 3 mm and at most 6 mm, at most 5 mm or at most 4 mm and so on.

BRIEF DESCRIPTION OF THE FIGURES

The invention is explained hereinafter on the basis of the exemplary embodiments illustrated in the drawing, without the invention being restricted. In the figures.

DETAILED DESCRIPTION

Figure 1:
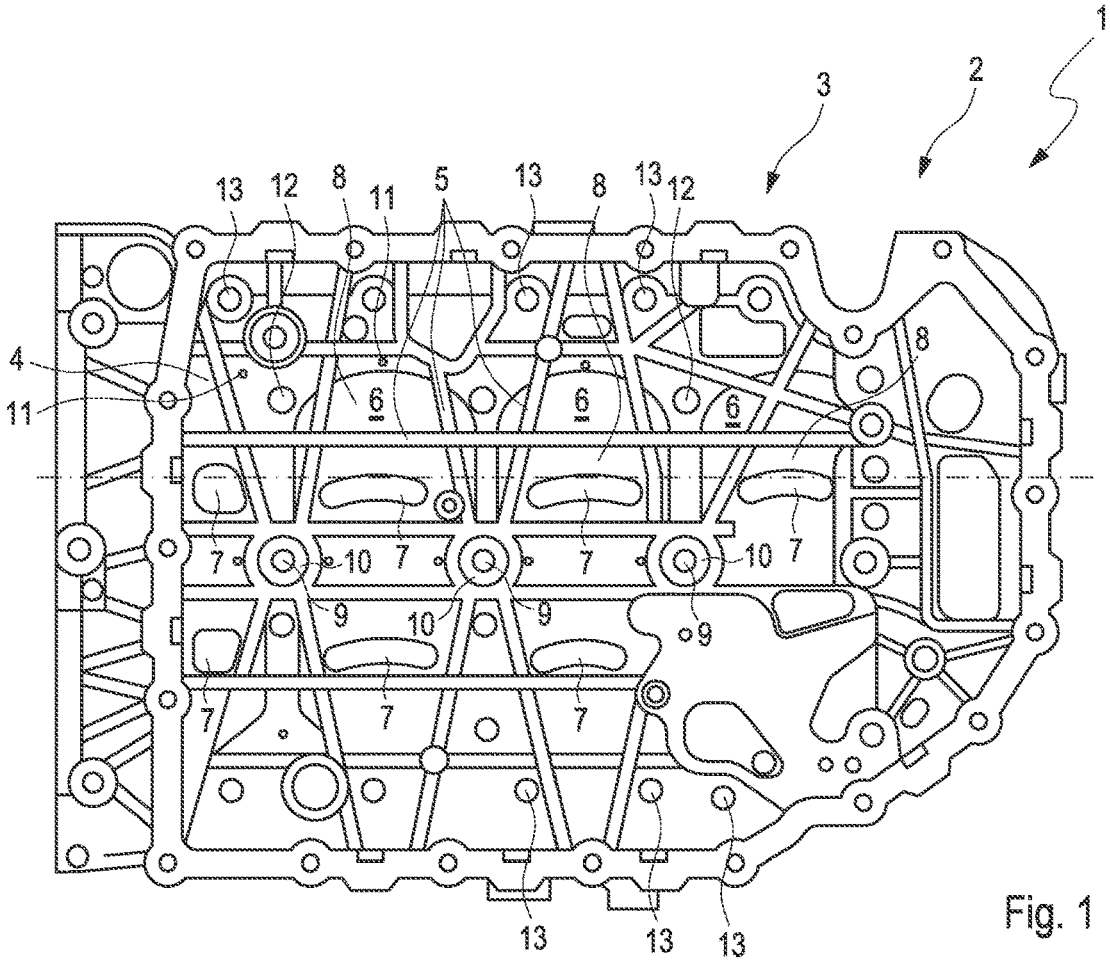
FIG. 1 shows a schematic illustration of a part of an internal combustion engine and FIG. 2 shows a schematic sectional view of a region of the internal combustion engine.

FIG. 1 shows a schematic view of a part of an internal combustion engine 1, namely a region of a lubricant pan 2. Specifically, a lubricant pan upper part 3 of the lubricant pan 2 is shown, which separates a lubricant sump, jointly delimited by a lubricant pan lower part and the lubricant pan upper part 3, from a crank chamber accommodated in a cylinder crankcase of the internal combustion chamber 1.

The lubricant pan upper part 3 has a base component 4, which delimits the crankcase in the direction of the lubricant pan 2 or in the direction of the lubricant sump. Multiple ridges 5 originate from the base component 4, of which only a few are identified by way of example. The ridges 5 are arranged in relation to one another such that they form chambers 6 between them, which are peripherally closed in section. These chambers are also only identified by way of example.

In a part of the chambers 6, lubricant passage openings 7 open, which are formed in walls 8 that form part of the lubricant pan upper part 3 or the base component 4. The walls 8 delimit depressions which are open in the direction of the crankcase. It can be seen that the lubricant passage openings 7 are arranged in multiple rows, which extend at least approximately or even precisely in parallel to one another.

Between the two rows of the lubricant passage openings 7, fastening recesses 9 are formed in the lubricant pan upper part 3, which are each enclosed by a ring ridge 10. The fastening recesses 9 are only indicated by way of example. The ridges 5 partially extend into the ring ridges 10 or originate from them. In the exemplary embodiment shown here, two of the ridges 5 extend in parallel to one another and accommodate the ring ridges 10 between them in this case.

To avoid an accumulation of air in the chambers 6 formed by the ridges 5, at least one ventilation opening 11 is produced in the lubricant pan upper part 3. In particular, a plurality of ventilation openings 11 is provided, in the exemplary embodiment shown here at least 10, at least 15, or at least 20. In addition to the at least one ventilation opening 11, at least one further ventilation opening 12 is provided. Further fastening recesses 13 are also produced in the lubricant pan upper part 3. These are solely indicated by way of example.

The ventilation opening 11 and the further ventilation opening 12 are used to ventilate the lubricant sump or the chambers 6, respectively, in the direction of the crankcase. It is apparent that the ventilation opening 11 has a significantly smaller through-flow cross-sectional area than the further ventilation opening 12 and each of the lubricant passage openings 7. In this way, on the one hand, sufficient ventilation of the chambers 6 is provided and, on the other hand, a rigidity of the lubricant pan upper part 3 and thus of the entire internal combustion engine 1 is not impaired.

Figure 2:
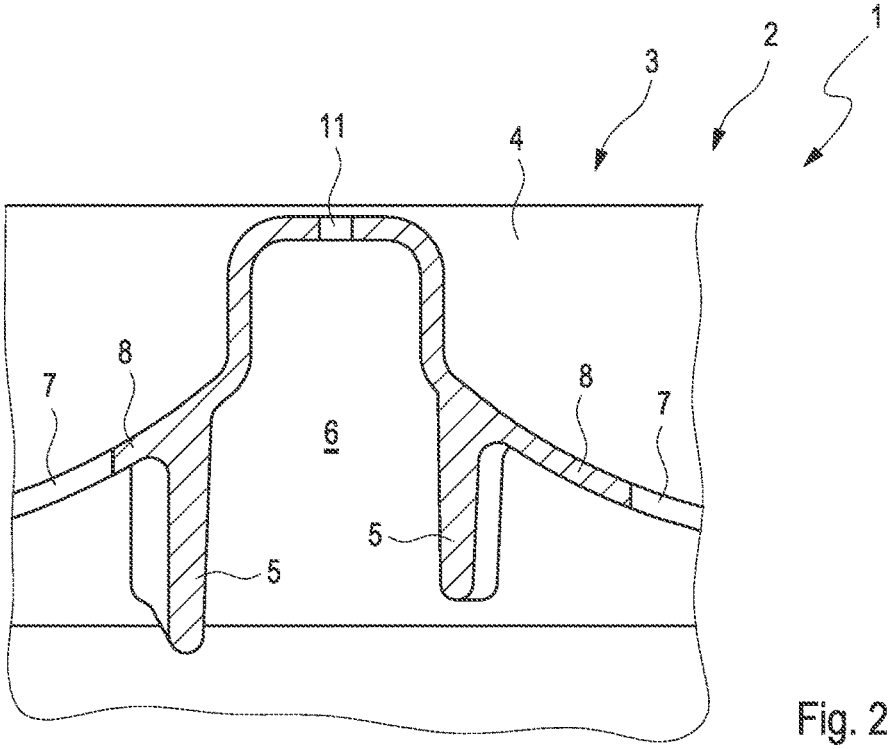

FIG. 2 shows a schematic sectional view of a region of the internal combustion engine 1 in the region of one of the ventilation openings 11. It is apparent that the ridges 5 enclose the chamber 6 like a dome and that the ventilation opening 11 is formed in the base component 4 at a point of the chamber 6 which is geodetically highest in the installed location of the internal combustion engine 1. Extremely effective ventilation of the chamber 6 is achieved in this way.

LIST OF REFERENCE NUMERALS

1 internal combustion engine
2 lubricant pan
3 lubricant pan upper part
4 base component
5 web
6 chamber
7 lubricant passage opening
8 wall
9 fastening recess
10 ring web
11 ventilation opening
12 ventilation opening
13 fastening recess

The invention claimed is:

1. An internal combustion engine, comprising:

a cylinder crankcase delimiting a crank chamber and a lubricant pan accommodating a lubricant sump;

a lubricant pan upper part arranged between the crank chamber and the lubricant sump;

a lubricant pan lower part fastened on the lubricant pan upper part;

a plurality of ridges originating from a base component of the lubricant pan upper part, and extending in the direction of the lubricant sump, certain ridges of the plurality of ridges partially intersecting certain other ridges of the plurality of ridges, thereby forming chambers which are peripherally closed in section between intersecting ridges; and lubricant passage openings formed in the lubricant pan upper part and opening into at least part of the chambers, the crank chamber and the lubricant sump being fluidically connected via the lubricant passage openings;

wherein, in at least one of the chambers, into which none of the lubricant passage openings open, at least one ventilation opening opens; and wherein the at least one ventilation opening additionally fluidically connects the crank chamber and the lubricant sump and has a smaller through-flow cross section in comparison to the lubricant passage openings.

2. The internal combustion engine as claimed in claim 1, wherein:

the lubricant passage openings are formed in walls of the lubricant pan upper part;

the walls delimit depressions that are open in the direction of the crank chamber and are spaced apart from one another; and the depressions are arranged overlapping with crank pins of the crankshaft in the axial direction with respect to an axis of rotation of a crankshaft of the internal combustion engine.

3. The internal combustion engine as claimed in claim 1, wherein:

the lubricant passage openings are provided in two rows arranged in parallel to one another and to the axis of rotation of the crankshaft;

fastening recesses are formed between the two rows in the lubricant pan upper part; and the fastening recesses are enclosed by the ridges.

4. The internal combustion engine as claimed in claim 1, wherein:

in addition to the ventilation opening, at least one further ventilation opening is provided; and a flow cross section of the further ventilation opening is larger than a flow cross section of the ventilation opening and smaller than flow cross sections of the lubricant passage openings.

5. The internal combustion engine as claimed in claim 1, wherein the lubricant passage openings are non-round and the ventilation opening is round.

6. The internal combustion engine as claimed in claim 1, wherein the ventilation opening is formed in a region that is geodetically highest in the installed location of the internal combustion engine of a region of the base component delimiting the respective chamber.

7. The internal combustion engine as claimed in claim 1, wherein the ventilation opening is formed in one of the walls.

8. The internal combustion engine according to claim 1, wherein the further ventilation opening has dimensions in a first direction, which are at least 75% and/or at most 125% of dimensions of one of the lubricant passage openings in the same direction, and/or wherein the further ventilation opening has dimensions in a second direction perpendicular to the first direction, which are at most 25% of dimensions of the lubricant passage openings in this direction.

9. The internal combustion engine according to claim 1, wherein the ventilation opening has dimensions in the first direction and the second direction which are at most 25% of the dimensions of the further ventilation opening in the respective direction.

10. The internal combustion engine according to claim 1, wherein the ventilation opening has a diameter of at least 1 mm and/or at most 6 mm.

11. The internal combustion engine as claimed in claim 2, wherein:

the lubricant passage openings are provided in two rows arranged in parallel to one another and to the axis of rotation of the crankshaft;

fastening recesses are formed between the two rows in the lubricant pan upper part; and the fastening recesses are enclosed by the ridges.

12. The internal combustion engine as claimed in claim 2, wherein:

in addition to the ventilation opening, at least one further ventilation opening is provided; and a flow cross section of the further ventilation opening is larger than a flow cross section of the ventilation opening and smaller than flow cross sections of the lubricant passage openings.

13. The internal combustion engine as claimed in claim 3, wherein:

in addition to the ventilation opening, at least one further ventilation opening is provided; and a flow cross section of the further ventilation opening is larger than a flow cross section of the ventilation opening and smaller than flow cross sections of the lubricant passage openings.

14. The internal combustion engine as claimed in claim 2, wherein the lubricant passage openings are non-round and the ventilation opening is round.

15. The internal combustion engine as claimed in claim 3, wherein the lubricant passage openings are non-round and the ventilation opening is round.

16. The internal combustion engine as claimed in claim 4, wherein the lubricant passage openings are non-round and the ventilation opening is round.

17. The internal combustion engine as claimed in claim 2, wherein the ventilation opening is formed in a region that is geodetically highest in the installed location of the internal combustion engine of a region of the base component delimiting the respective chamber.

18. The internal combustion engine as claimed in claim 3, wherein the ventilation opening is formed in a region that is geodetically highest in the installed location of the internal combustion engine of a region of the base component delimiting the respective chamber.

19. The internal combustion engine as claimed in claim 4, wherein the ventilation opening is formed in a region that is geodetically highest in the installed location of the internal combustion engine of a region of the base component delimiting the respective chamber.

20. The internal combustion engine as claimed in claim 5, wherein the ventilation opening is formed in a region that is geodetically highest in the installed location of the internal combustion engine of a region of the base component delimiting the respective chamber.

* * * * *